US007250087B1

(12) United States Patent
Tyson et al.

(10) Patent No.: US 7,250,087 B1
(45) Date of Patent: Jul. 31, 2007

(54) CLOGGED NOZZLE DETECTION

(75) Inventors: James Tyson, 7563 Park Ave., Pennsauken, NJ (US) 08109; Janez Makovsek, Maribor (SI)

(73) Assignee: James Tyson, Pennsauken, NJ (US)

( * ) Notice: Subject to any disclaimer, the term of this patent is extended or adjusted under 35 U.S.C. 154(b) by 0 days.

(21) Appl. No.: 11/434,840

(22) Filed: May 16, 2006

(51) Int. Cl.
*B08B 7/04* (2006.01)

(52) U.S. Cl. ..... 134/18; 702/183; 702/39; 702/56; 702/105

(58) Field of Classification Search ..... 134/42, 134/18; 702/183, 39, 56, 105
See application file for complete search history.

(56) References Cited

U.S. PATENT DOCUMENTS

| | | | |
|---|---|---|---|
| 4,183,011 | A | 1/1980 | Massa |
| 5,681,401 | A | 10/1997 | Gardner et al. |
| 5,759,424 | A | 6/1998 | Imatake et al. |
| 5,904,163 | A | 5/1999 | Inoue et al. |
| 5,911,232 | A | 6/1999 | Mokuo et al. |
| 5,923,432 | A | 7/1999 | Kral |
| 5,954,271 | A | 9/1999 | Le |
| 6,092,538 | A | 7/2000 | Arai et al. |
| 6,123,271 | A | 9/2000 | Delaney et al. |
| 6,178,974 | B1 | 1/2001 | Kobayashi et al. |
| 6,431,185 | B1 | 8/2002 | Tomita et al. |
| 6,625,568 | B2 * | 9/2003 | Tyson ..... 702/183 |
| 6,772,094 | B2 * | 8/2004 | Tyson ..... 702/183 |
| 2001/0006072 | A1 | 7/2001 | Kobayashi et al. |

FOREIGN PATENT DOCUMENTS

| | | |
|---|---|---|
| DE | 4010066 | 10/1991 |
| DE | 19732856 | 2/1999 |
| DE | 29919445 | 5/2001 |
| EP | 0793939 | 9/1997 |
| FR | 2442618 | 6/1980 |
| JP | 409295114 A | 11/1998 |

* cited by examiner

*Primary Examiner*—Joseph L. Perrin
(74) *Attorney, Agent, or Firm*—Norman E. Lehrer

(57) ABSTRACT

Sound detection techniques and sound discrimination techniques are used to analyze the real time sounds generated during the operation of cleaning heads operating within a vessel to determine if the cleaning heads are operating properly. During a typical cleaning operation pressurized cleaning solution is dispensed through a plurality of rotating nozzles inside the vessel. As the nozzles rotate the spray moves about the interior of the vessel creating a unique sound pattern. By placing one or more pickups on the exterior of the vessel the sound is captured and fed to an analyzing device for analysis. The peaks in the captured sound pattern are divided into the number of nozzles and stored in an equal number of buffers. After averaging, the buffers a compared to each other. One buffer that significantly differs froms the others indicates that the nozzle associated with that buffer is defective.

3 Claims, 13 Drawing Sheets

CLOGGED NOZZLE DETECTION

FIELD OF THE INVENTION

The present invention is directed toward an improved method of monitoring rotating spray nozzles and particularly those used in tank cleaning operations. The approach is reliable in single axis and multiple axis systems. It is capable of working with any number of rotating nozzles and detects changes in individual spray nozzle performance including blockage, partial blockage, erosion (opening of the nozzle orifice) and missing or lost nozzles.

The algorithm useful with the invention allows the same to detect clogged, partially clogged, eroded, damaged or missing spray nozzles associated with rotating tank cleaning devices located inside closed vessels. This is done by isolating and evaluating the spray patterns associated with each spray nozzle during the cleaning operation. The status of individual nozzles can be monitored from either the inside or the outside of the vessel.

The invention can also be used for any application where it is desirable to separate the spray energy of the individual spray nozzles, (for example, for analysis), from the rest of the sound signal received by the sensor during the cleaning operation.

BACKGROUND OF THE INVENTION

Large vessels are used in many industries during the manufacturing, processing and distribution of numerous types of products. It is a well-accepted fact that these vessels must be cleaned on a regular basis in order to safeguard product quality and purity.

In order to effectively and economically clean such vessels clean-in-plane (CIP) systems have been developed and relied upon. Such systems eliminate the need for process equipment in large scale plants from having to be disassembled whenever sterilization and cleaning are required.

There are four factors that are critical and must be optimized to minimize both monetary costs and environmental costs in a properly managed CIP process. These factors are:

Time

Temperature

Mechanical Action

Chemical Activity

The total of these factors adds up to 100%. Therefore, one factor can be lessened and another increased to keep the total at 100%.

Time: With respect to the time element, some solids and liquids may be quite soluble while others are quite insoluble in the cleaning solution used. As a result the wash time will need to be varied depending on the application.

Temperature: Generally speaking, increasing the temperature of the cleaning solution will increase the rate of dissolution and therefore reduce cleaning time and water consumption.

Mechanical Action: Water for cleaning the tanks is normally introduced through a spray device. There are various kinds of spray devices that operate at varying pressures so that turbulence occurs in the water and in the water film on the surface being cleaned. As the pressure is increased, the impingement force and turbulence of the cleaning fluid goes up, improving the scrubbing action and reducing cleaning time and water consumption.

Chemical Activity: Cleaning chemicals such as detergents, caustics and acids are sometimes used to enhance the cleaning activity. The more aggressive the cleaning solution, the less time required to clean contaminated surfaces.

Once the CIP process has been worked out, then time, temperature, mechanical activity and chemical activity must be validated with each CIP process in order to assure that the desired cleaning cycle was performed. If any one factor fails to meet specified values then the expected cleaning did not take place.

The common presently used method of cleaning process tanks or vessels involves spraying the interior of the vessel with cleaning solutions. Examples of tank cleaners may be found in U.S. Pat. Nos. 6,123,271 and 5,954,271.

Referring to FIGS. 1A, 1B and 1C which represents a conventional system, it can be seen that the cleaning solution enters the device at the inlet causing the device to rotate about axis A1 (FIG. 1B) as well as about axis A2 (FIG. 1C) and exits the device through nozzles 106 located on axis A1. The nozzles are selected based on the size of the tank being cleaned, the product being removed, the available pressure and flow rate of cleaning solution, and jet stream parameters.

As is the case with a home dishwasher, the cleaning solution may be re-circulated during the cleaning operation. However, unless the solution is cleaned between uses the cleaning solution will likely contain foreign materials that can clog or damage the nozzle.

If a nozzle were to clog, then:

1) the flow of cleaning solution through the nozzle would be reduced or totally blocked, 2) the parameters of the nozzle jet stream could be dramatically altered, 3) the nozzle would not clean as expected, 4) the cleaning device as a sum of all nozzles would not be operating as required to clean the tank.

If, on the other hand, a nozzle were to open up, then:

1) the flow of cleaning solution thru the nozzle would increase possibly reducing flow and pressure to the remaining nozzles, 2) the parameters of the nozzle jet stream could be dramatically altered, 3) the failed nozzle would not clean as expected, 4) the cleaning device as a sum of all nozzles would not be operating as required to clean the tank.

The present invention is directed toward a method of for monitoring individual nozzle performance and detecting when a nozzle becomes clogged or enlarged.

German patent DE 29919445 suggests that if there are at least two alternating jets in a dishwasher machine, then the jet armature rotation sensor can be designed in such a way that it can, depending on the expected frequency spectrum of the spray striking the sensor wall, detect which jet is blocked in its rotational movement. Assuming this patent defines a "jet" as being a single spray nozzle on the "jet armature" (as opposed to one of several jet armatures) then it is accepted that a dishwasher wall may be designed to vibrate differently depending on where it is struck by the jet spray. That being the case, then in order to identify individual nozzles, an armature must be designed to direct each nozzle to unique positions on the sensor wall. The sensing electronics would then detect the presence of each unique frequency signature. There are, however, a number of problems with this design First, the rotating arm and sensing wall must be especially designed to work together to generate the unique spectrums for each and every nozzle. This is possible for the invention taught in the German patent since they are designing and building an entire new product. In the tank cleaning industry this is not possible since an endless array of tanks are being cleaned by an ever widening assortment of tank cleaners. It is not possible to generate unique frequency signatures for each individual nozzle on a tank cleaner.

Second, the approach shown by the German patent requires that the processing electronics evaluate and detect "specific frequency signatures" unique to each nozzle. As the number of nozzles increases the task of identifying unique signatures becomes very complicated and costly.

Even further, the approach shown in the German patent "detects which jet is blocked in its rotational movement". It does not detect partially blocked, eroded or damaged nozzles. The present invention teaches an improved method of detecting clogged nozzles that is not related to the frequency signature of nozzles, does not require special preparation to the rotating arm or the sensing wall, can be applied to any number of rotating nozzles and is capable of detecting nozzle performance ranging from fully clogged, to enlarged.

There is another very important drawback to the approach in the German patent. It was designed for use in systems where the spray nozzles rotate in a fixed path. This is necessary in order to direct each nozzle to a unique position along the sensing wall, see FIG. 2.

In dual axis systems, each nozzle sprays the entire inner surface of the tank. For example, referring to FIG. 3, the spray jet from each nozzle travels from the top of the tank downward along the side wall until it reaches the bottom. It then travels a short distance along the bottom, turns and proceeds upward along the opposite side wall until it reaches the top of the tank. The pattern resembles a FIG. 8. With the completion of each pass, the FIG. 8 spray pattern rotates slightly causing the spray to take a parallel but different path with each successive pass. Eventually the spray pattern rotates a full 360 degrees causing every nozzle to spray the entire inner surface of the tank. (See FIGS. 4*a* and 4*b*.) Thus, it would not be possible restrict a particular nozzle to a specific area of the tank wall.

In U.S. Pat. No. 5,681,401 to Maytag, it is suggested that a reduction in the signature frequency may indicate a blockage. FIG. 5 shows a comparison of two time series. FIG. 5A represents the sound signature acquired from a single armature dishwasher. FIG. 5B represents the sound signature from a three nozzle dual axis spray cleaner. Each peak shown in FIGS. 5A and 5B represents the vibrations captured by the sensor as the spray passed the sensing area.

An examination of FIG. 5A shows that the peak to peak amplitude of each nozzle is more or less the same amplitude. The frequency of the spray signature is the frequency of the time series consisting of combined nozzle spray peaks. If one of the two nozzles were to clog, then every other peak would be eliminated and the frequency of the time series would be one-half of the original. Thus a blocked nozzle would indeed result in a change in frequency. On the other hand consider the case where the nozzle armature for one reason or another slows to one-half of its original velocity. The resultant time series would then be one-half of its original frequency. Based on the foregoing assumption, the change in frequency would be falsely interpreted as a blocked nozzle. The fact is, basing blocked nozzle detection on the spray signature frequency is very unreliable. The signature frequency can be affected by many things, some of which are normal and some of which may not be so normal.

For example, an examination of the time series in FIG. 5A shows a wide variation in peak to peak amplitude. Based on the above hypothesis we must conclude that one or more of the spray nozzles are experiencing a blockage. Such a conclusion, however, would be false. The fact is the tank cleaner shown in FIG. 5A is operating perfectly normally. Given that all of the spray nozzles are identically the same, are operating properly, have no blockage, and have equal flow and pressure, why then are the peak to peak amplitudes significantly different. The answer lies in the fact that the intensity of the vibrations received by the sensor is not solely a function of the impingement force but is also a function of the displacement between the impingement location and the sensor. FIG. 6 shows a typical relationship between impingement displacement and attenuation of the impact induced vibrations in the tank wall. From FIG. 6 we note that the vibrations are a maximum when the spray jet impacts the area directly under the sensor and decrease as displacement increases.

In the case of single axis cleaners, the spray jet follows the same path each and every revolution. This results in a constant impact displacement and a constant peak to peak attenuation. On the other hand, the spray path of the multiple axis tank cleaners changes with every rotation causing peak to peak variations in the impact displacement and peak to peak amplitude. Thus the hypothesis set forth in the Maytag patent does not apply in the case of multiple axis systems.

The present invention does not utilize frequency changes of the spray signatures to detect nozzle blockages. Instead this invention teaches to separate and measure the impingement force associated with each spray nozzle. Variations due to impingement displacement are removed by averaging impingement force over many passes.

SUMMARY OF THE INVENTION

The average magnitude of a point force exerted on the tank wall when a water jet strikes the wall comes from the momentum change of the jet stream and is given by the formula:

$$\text{Force}=\text{jet mass flow}\times\text{change in velocity}$$

Or $$F=Q(\text{delta}V) \quad (1)$$

When no rebound is assumed, the change in velocity of the jet stream can be expressed in terms of nozzle supply pressure, P, and water density, roe, where:

$$\text{Delta } V=\text{sqroot}(2P/roe) \quad (2)$$

Substituting equation (2) into equation (1) the impingement force is expressed in terms of flow and pressure where:

$$\text{Impingement force } F=Q\times[\text{sqroot}(2P/roe)] \quad (3)$$

Where Q=mass flow

From equation 3 it is recognized that impingement force is proportional to (1) the flow of the water in the jet stream and (2) the driving pressure. The driving pressure in this case is determined by the pump that is supplying the cleaning solution. Normally cleaning operations are conducted at a fixed predetermined pressure. We must assume that during the cleaning operation, the pump is in good working order and is supplying cleaning solution at a fixed constant pressure. That being the case, from equation 3, it can be stated that the impingement force caused by the spray jet is proportional to the flow contained in the jet stream. By design, the flow in the jet stream is equal to the flow through the nozzle which generated the jet stream.

The spray nozzle is a very important element of the tank cleaning process. The purpose of the spray nozzle is to deliver the required quantity cleaning solution to the tank walls in a specific and desired manner. The flow through a nozzle is represented by:

$$\text{Nozzle Flow}=\text{orifice area}\times\text{fluid velocity}\times\text{time} \quad (4)$$

From equation 4 it can be concluded that the mass flow of the jet stream is a function of the nozzle orifice area and the exit velocity of the jet stream. Thus anything that alters the fluid transmission through the nozzle will have an adverse effect on the mass flow and ultimately the impingement force on the wall of the tank.

It is also a known fact that the intensity of the vibrations induced in the tank wall by the water jet is proportional to the impingement force F, (equation 3). Therefore, we can conclude from the above discussion, by monitoring the intensity of the vibrations caused by the impingement of the spray jet, we can gauge the mass flow of water producing the vibrations and consequently the performance of the jet nozzle itself. This relationship provides a quick and accurate means of detecting clogged, partially clogged or eroded nozzles in rotating tank cleaning systems.

The present invention is used to isolate and measure the vibration intensity caused by the impinging spray jet associated with each nozzle independently of all of the other nozzles. And having determined the intensity, validate nozzle performance by comparing real time measured performance against a known "good and accepted" reference.

This method is not frequency spectrum based; it is independent of nozzle rotational velocity; it does not require special preparation to the rotating arm or the sensing wall; it can be applied to any number of rotating nozzles; it is capable of detecting nozzle performance ranging from fully clogged, to enlarged and it works with single axis and multi axis systems A sensor is placed on the wall of the vessel in such a location where the nozzle jets will pass. As the nozzle jets rotate inside of the tank, they induce vibrations into the vessel walls. The sensor captures the vibrations and converts them to an electrical signal. Each time a spray jet passes the sensor, the vibrations captured by the sensor increase sharply causing a corresponding peak in the sensor's output signal, FIG. 7.

The amplitude of the peaks shown in FIG. 7 is proportional to the force exerted on the tank wall by a spray jet. One aspect of the invention is to measure the amplitude of each peak. The output signal is AM discriminated to capture the envelope representing the sound peak. The result is a time series showing each nozzle jet as it passes the sensor, FIG. 8.

An examination of FIG. 8 reveals that in addition to the desired sound peaks, the discriminator output signal also contains a DC component related to the average sound level in the tank, and an AC component caused by the motion of the spray jets. The DC component is extraneous and must be discarded. The discriminator output is therefore processed to remove the DC component. The result is a new time series composed only of sound peaks, FIG. 9.

Since the sensor was attached at a location where it could sense multiple nozzles, it is understood that sound peaks in FIG. 9 are associated with multiple nozzles. The order of appearance is known based on the selected cleaning device and sensor placement. With this information the de-multiplexer locates a peak and places it in the appropriate buffer. Each buffer is then RMS averaged to determine the average peak amplitude. Any effects of impact displacement are removed by the RMS averaging.

We now have a single numerical value representing the average impingement force of each spray nozzle. Based on equation 3 and 4 and assuming pressure to be a constant, then any change in this value must be attributable to a corresponding change in flow which directly relates to the nozzle. Therefore, blockages may be identified by comparing the average impingement force of each spray nozzle to the average impingement force of the other nozzles on the nozzle armature, FIG. 1 item 104, as well as comparing the average impingement force to previous calculations obtained from the same nozzle during previous tank cleaning operations.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 10:
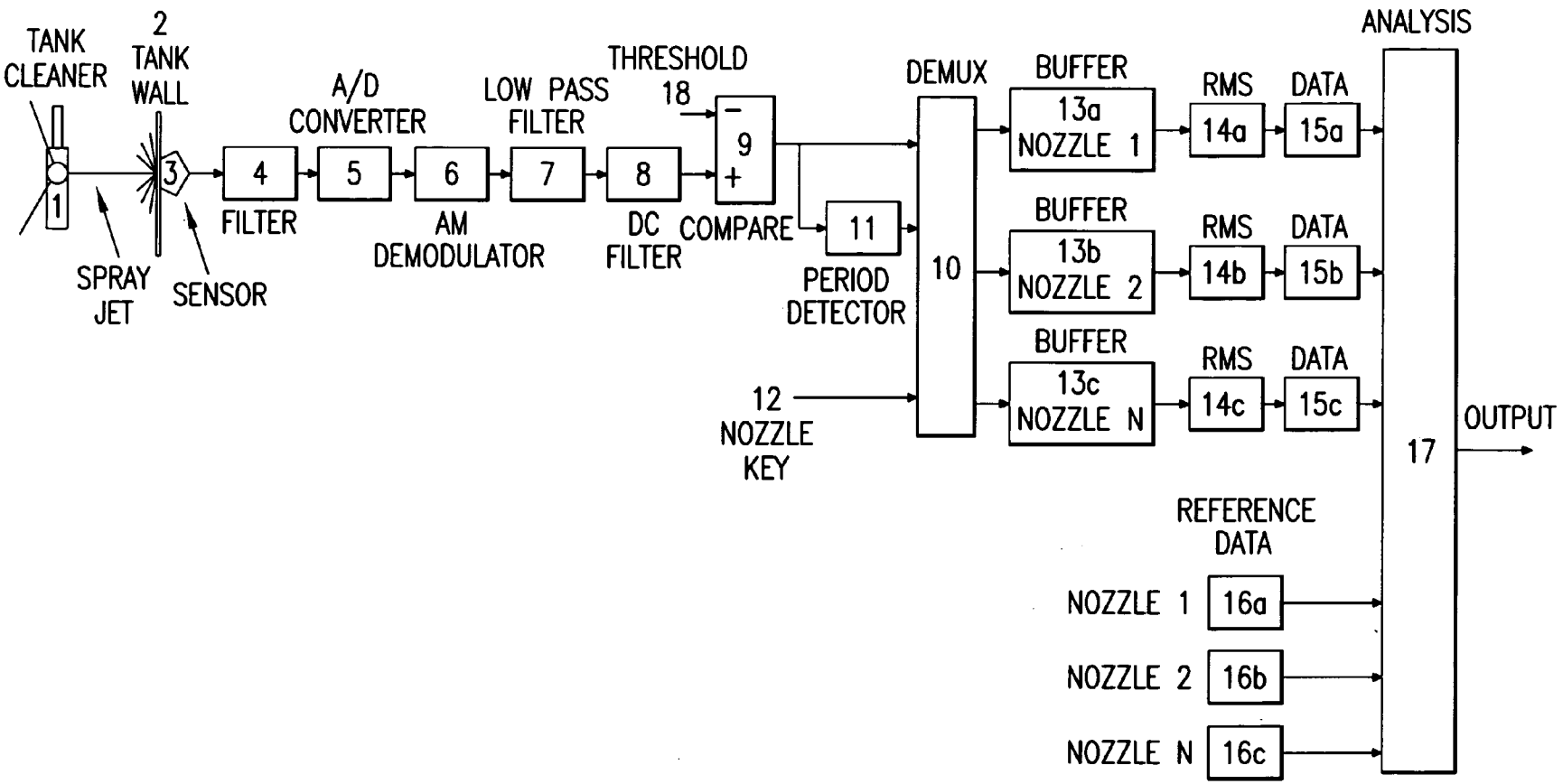
FIG. 10 is an overall schematic block diagram of the signal processing system of the present invention.

FIG. 10 is an overall schematic block diagram of the signal processing system of the present invention. As illustrated therein tank cleaner 1 rotates within the tank while performing a cleaning operation. The cleaning solution exits the nozzle and strikes the tank wall 2 inducing vibrations into the wall.

Sensor 3 which may be mounted on the exterior wall of the tank or vessel captures the vibrations and converts them to an electrical signal. The electrical signal is then filtered 4 to remove unwanted spectral components and is then converted to a digital signal in A/D converter 5. The A/D output signal is then AM demodulated at 6, buffered and low pass filtered 7.

The sound peak characteristics vary from application to application depending on the tank configuration, sensor location, and selected tank cleaner. In the preferred embodiment the pass band of the low pass filter 7 and sample rate of the A/D converter 5 are selected to optimally represent the sound peak.

Figure 9:
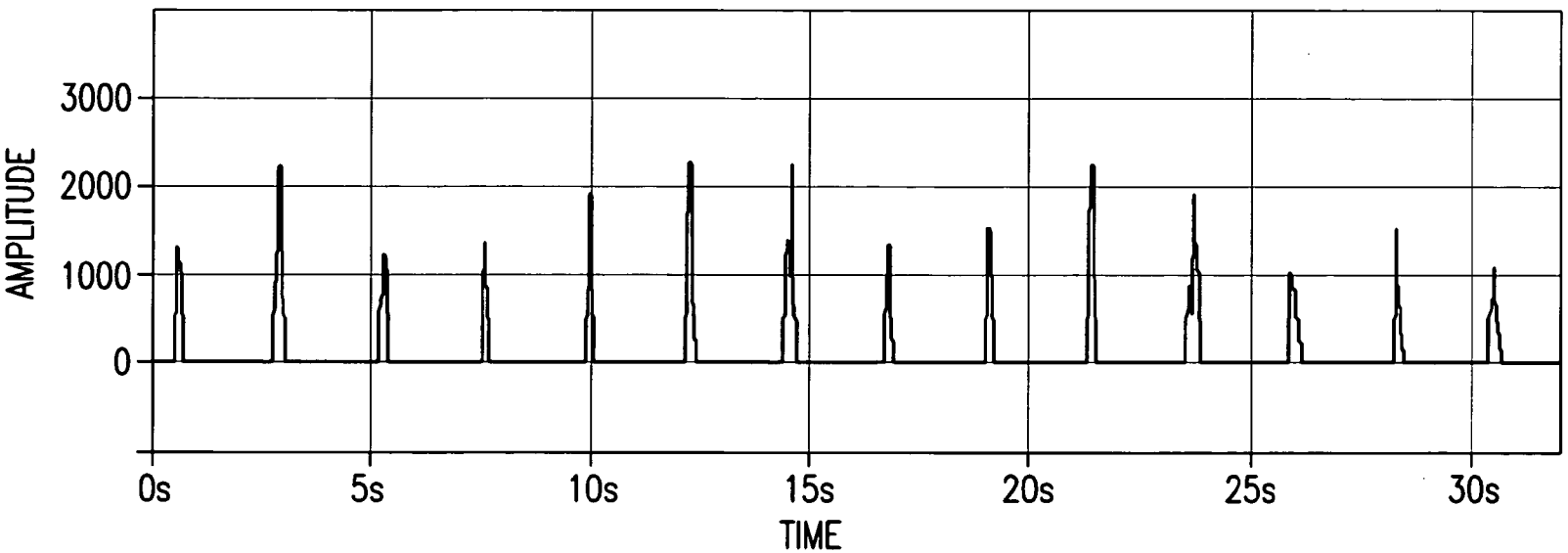
FIG. 9 is a graph similar to FIG. 8 but showing the spray peaks after being separated from the baseline signal.

FIG. 9 shows a time series of the discriminator output. As noted above, the demodulated signal, in addition to the sound peaks, has a DC component related to the overall sound level in the tank, and an AC component related to the motion of the spray. The DC component is not relevant to the calculation of individual nozzle performance and can be discarded.

Figure 11:
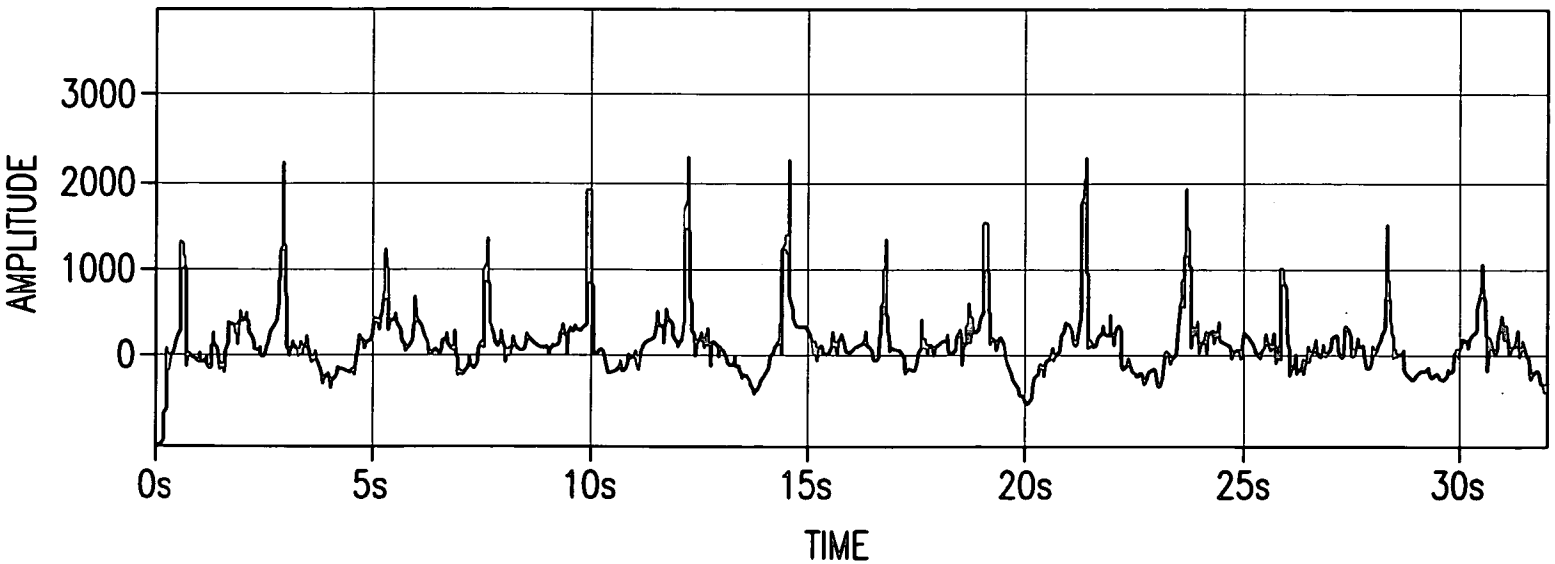
FIG. 11 is a graph illustrating a discriminated signal after removing the DC component.

The DC component is first stripped by passing the signal through a DC filter 8. FIG. 11 shows the resultant time series.

Next the spray peak component is stripped from the baseline component that lies between the peaks. This is accomplished by comparing the signal shown in FIG. 11 to a DC threshold 19 in comparator 9. The DC threshold is established at a level consistent with the base of the sound peaks. Everything below the DC threshold is discarded leaving only the sound peaks. This is accomplished by subtracting the threshold from each sample in the time series and discarding all differences having a negative value.

For example:

difference=(sample−threshold)

If difference is greater than zero then:

comparator output=new sample=(sample−threshold):

If difference is equal to or less than zero then:

comparator output=new sample=0

The result is a new time series composed only of sound peaks as shown in FIG. 9. The comparator output is passed to the de-multiplexer 10 that will sort the sound peaks by nozzle.

Figure 1A:
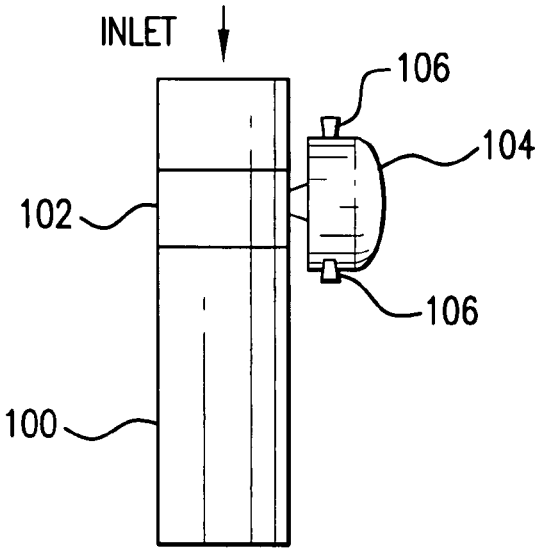
FIGS. 1A, 1B and 1C are simplified schematic representations of a multiple axis tank cleaning device with respect to which the present invention can be applied.
Figure 1B:
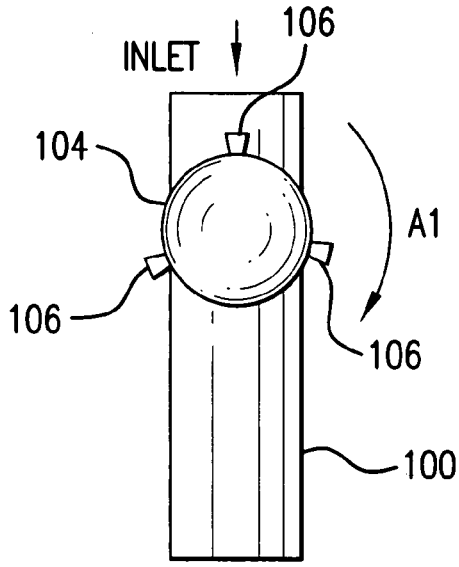
Figure 1C:
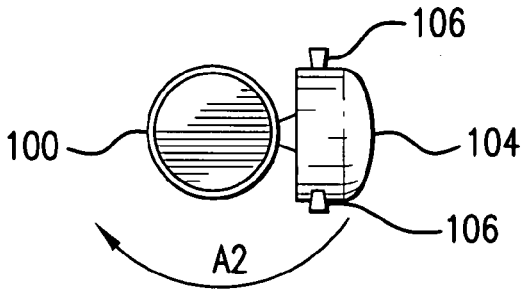
Figure 2:
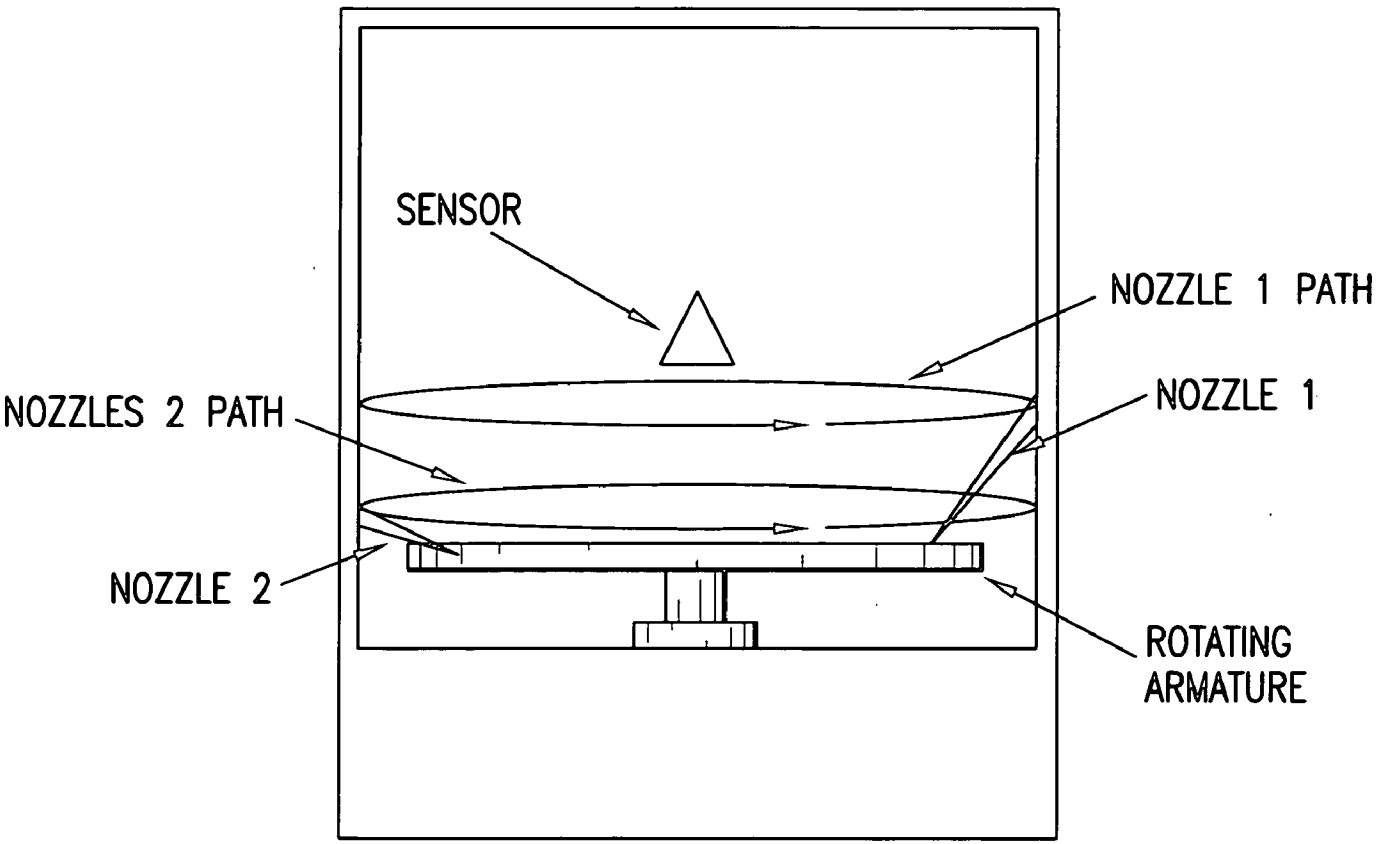
FIG. 2 illustrates a prior art dishwasher having spray jets directed to specific areas of a sensor wall.
Figure 3:
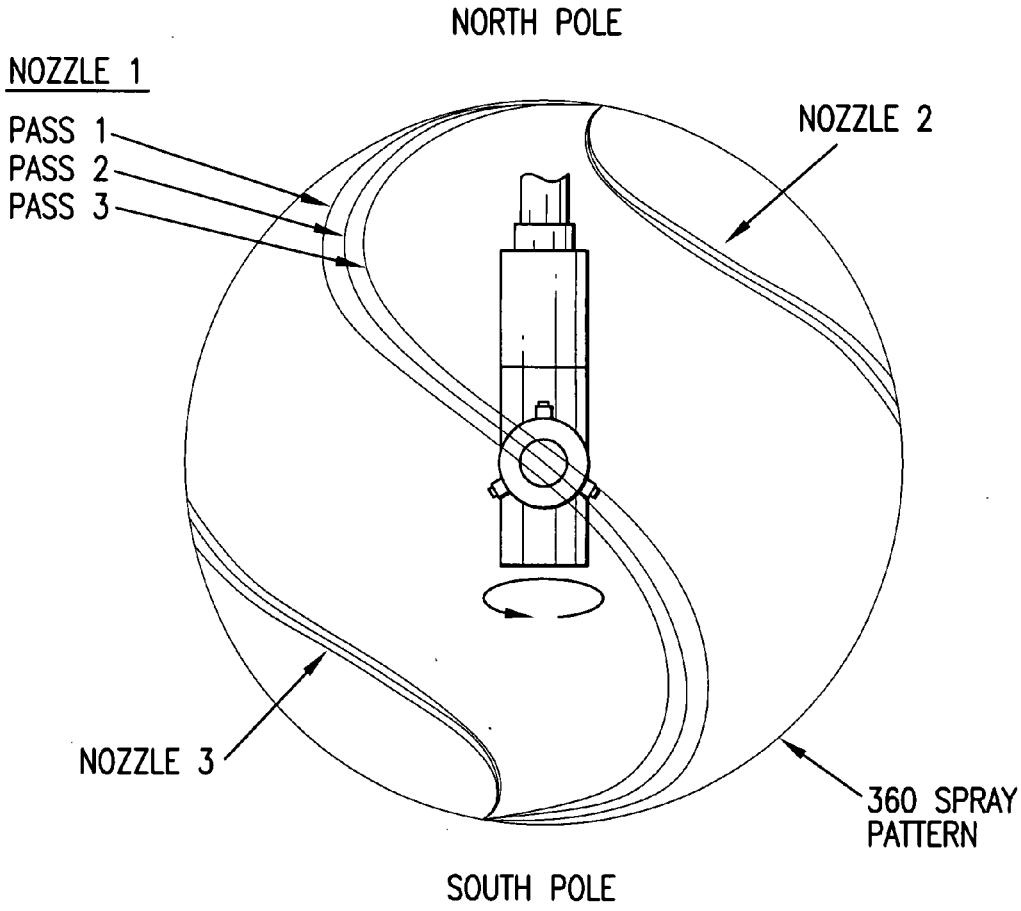
FIG. 3 illustrates the typical nozzle movement for a two axis tank cleaner.
Figure 4A:
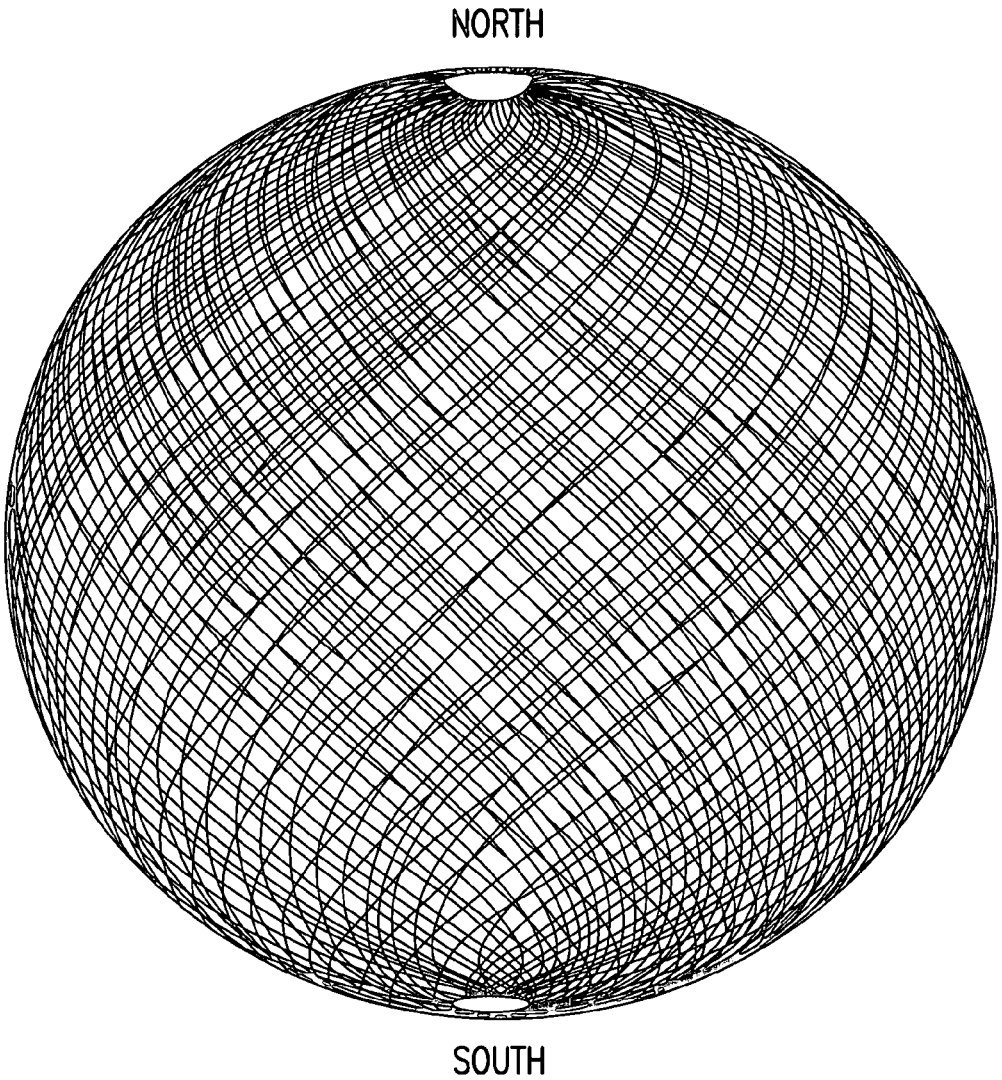
FIGS. 4*a* and 4*b* illustrate dual axis spray coverage from the equator and from a pole, respectively.
Figure 4B:
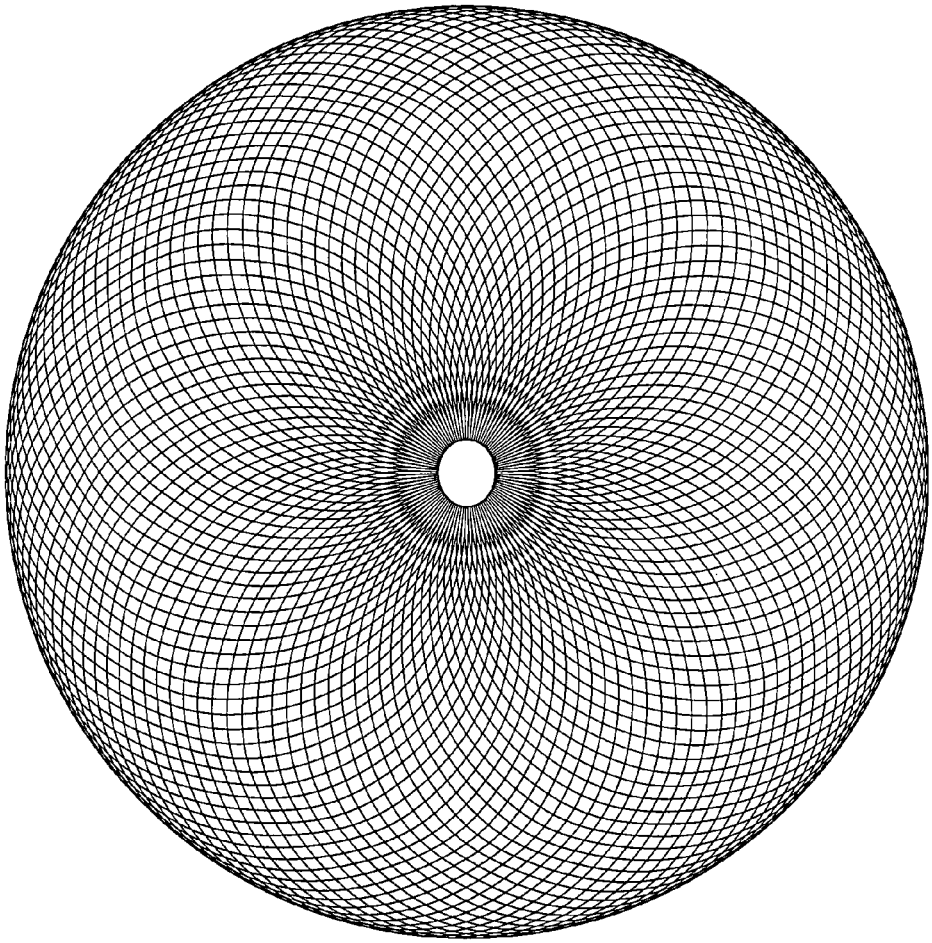
Figure 5A:
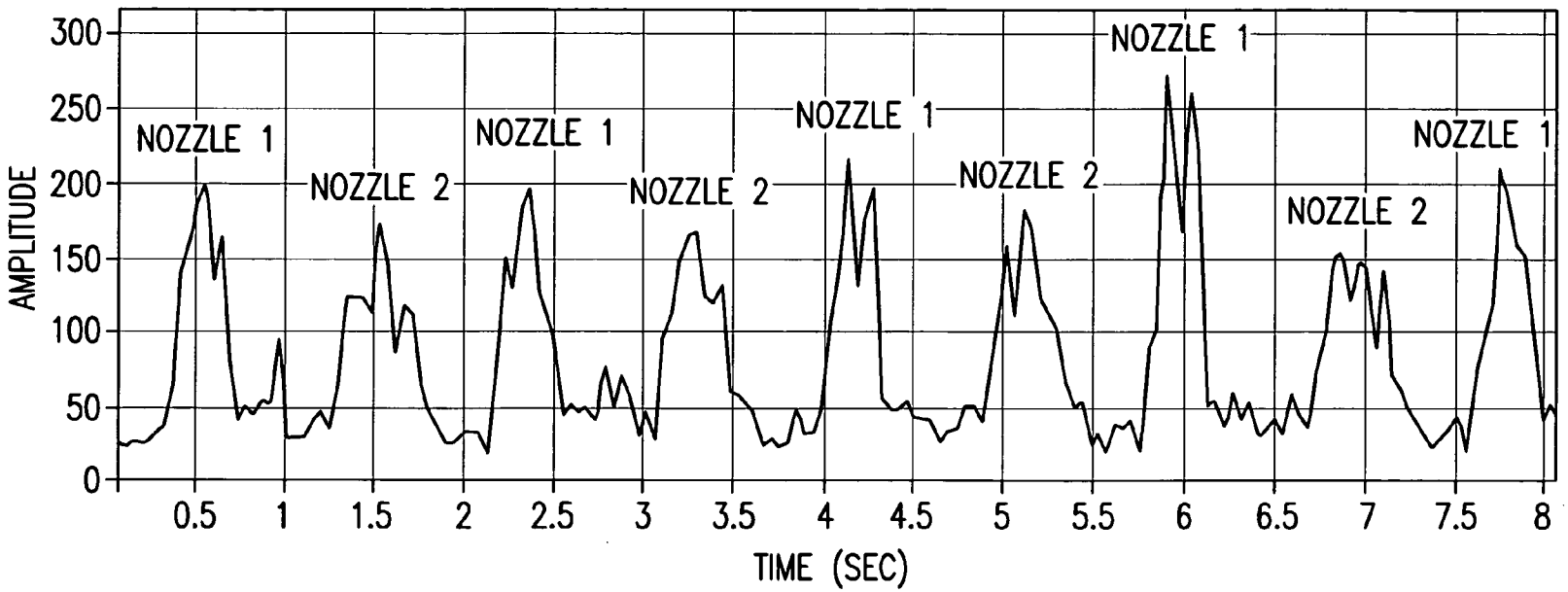
FIGS. 5A and 5B illustrate time series comparing single and dual axis signatures.
Figure 5B:
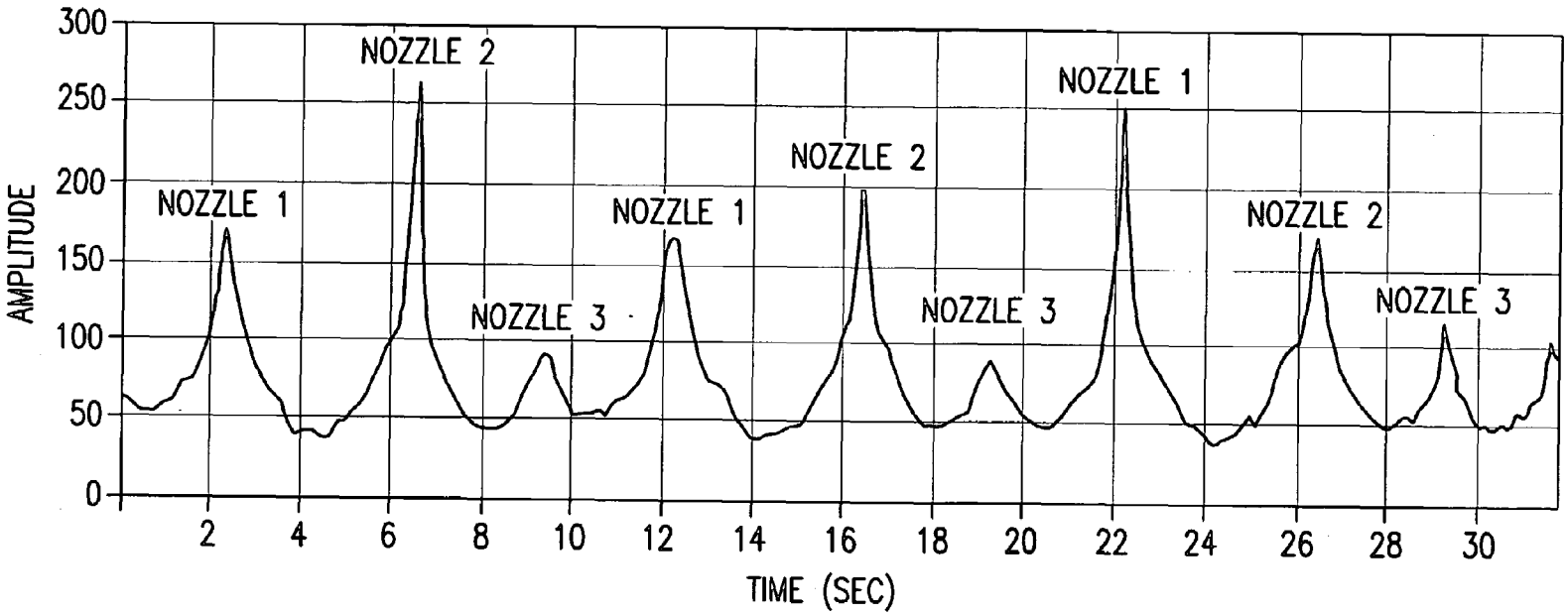
Figure 6:
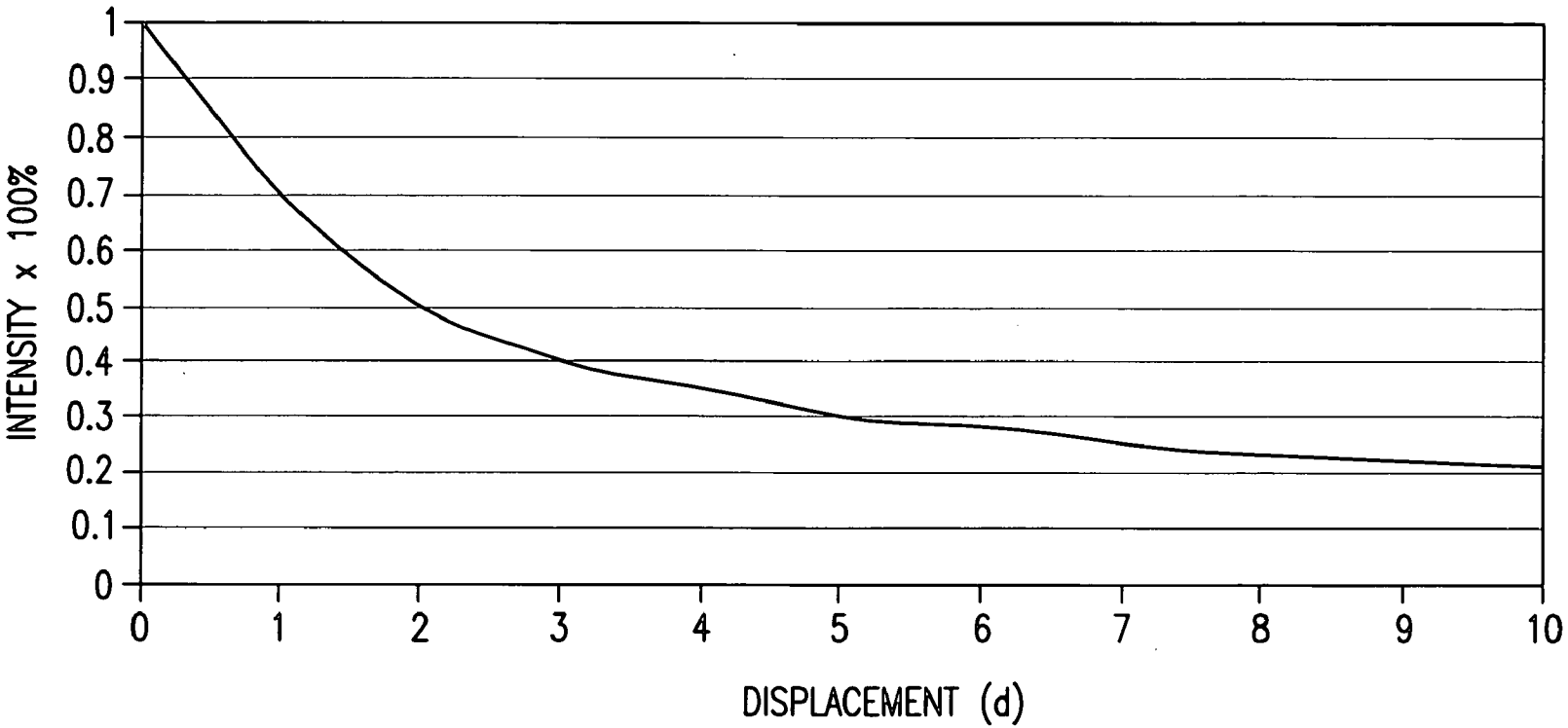
FIG. 6 is a graph illustrating vibration versus impingement displacement.
Figure 7:
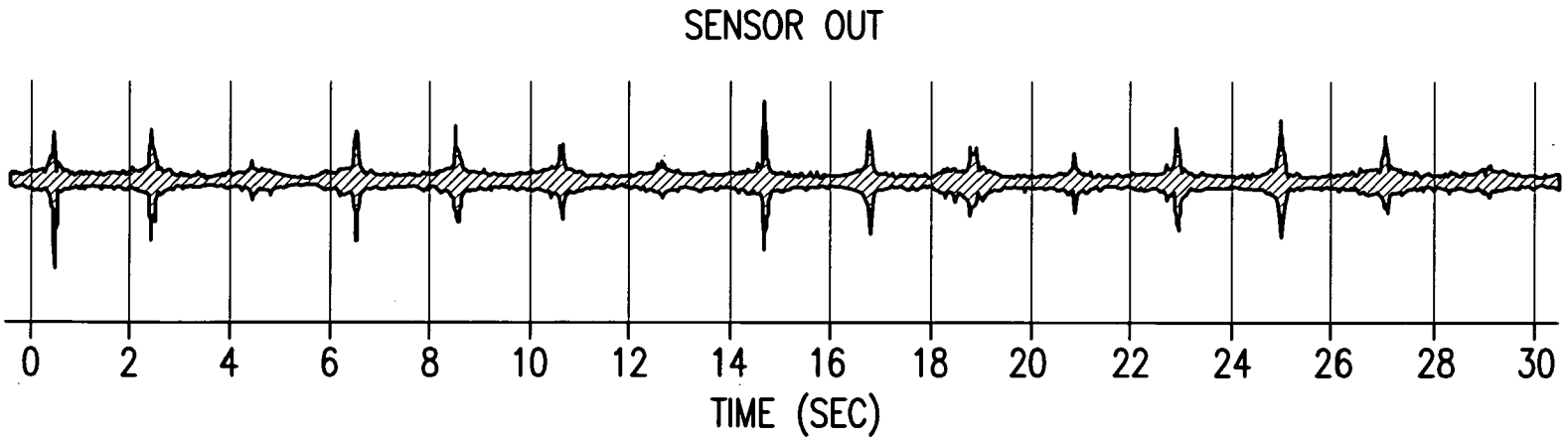
FIG. 7 is a graph illustrating time series and showing a raw sensor output signal.
Figure 8:
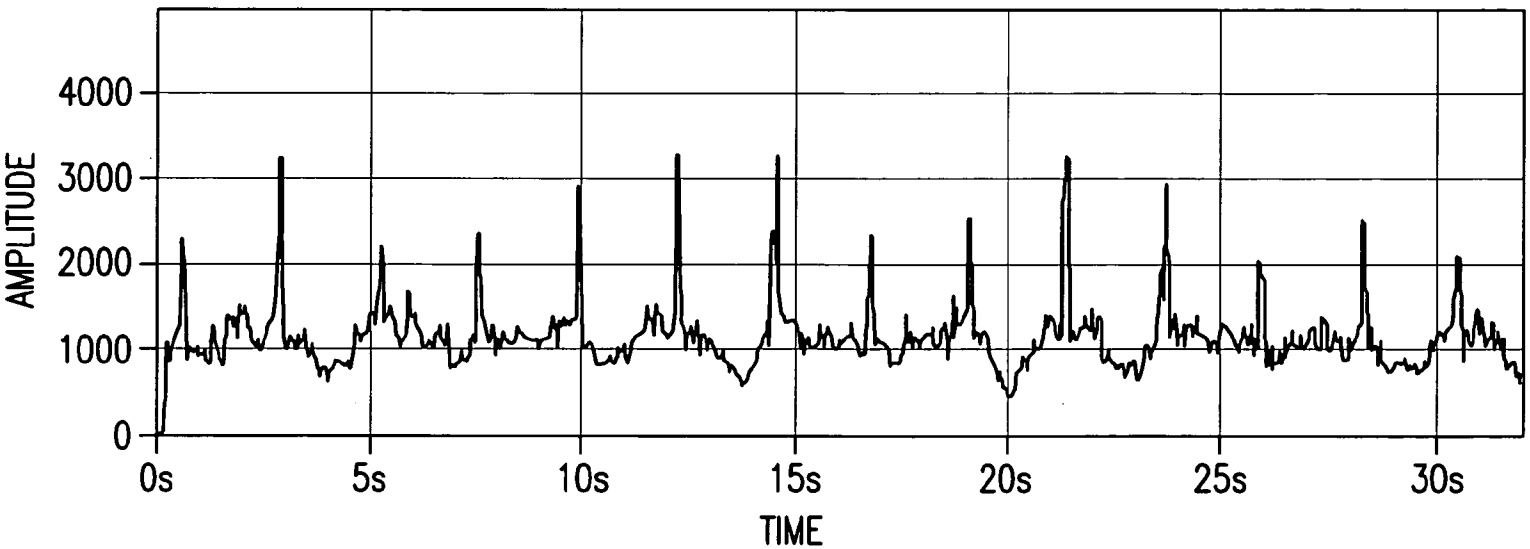
FIG. 8 is a graph illustrating a discriminator output signal and showing spray jet peaks.

Sorting is a process where the maximum sample from each sound peak is taken and placed in an individual buffer by nozzle. For example, the cleaning device described in FIG. 1 above has three nozzles. The spray jet from each nozzle passes the sensor once each rotation in the order of nozzle 1 followed by nozzle 2 followed by nozzle 3. This pattern repeats with each rotation of the nozzle assembly, (axis A1). With this information, the de-multiplexer can evaluate the sound peaks placing the maximum sample for all nozzle 1 sound peaks into buffer 13*a*, the maximum sample for all nozzle 2 sound peaks into buffer 13*b*, and the maximum sample for all nozzle 3 sound peaks into buffer 13*c*. Each buffer (13*a*, 13*b* and 13*c*), represents a single nozzle.

To sort the sound peaks two things are needed, (a) the order that the sound peaks appear in the time series, and (b) the mean time between peaks. The first requirement is obvious from the preceding discussion related to sorting and is inputted when the system is configured 12. The second item, mean time between peaks, is required to synchronize the de-multiplexer to the peak stream and is obtained from the period detector 11.

Each buffer 13*a*, 13*b* and 13*c*, is RMS averaged (14*a*, 14*b* and 14*c*) and stored in memory 15*a*, 15*b* and 15*c*, respectively. Since the contents of buffers 13*a-c* are the peak values of the sound peaks, the RMS average of 15*a-c* respectfully represents the average spray energy associated with each nozzle. The result is a significant improvement in the ability to measure nozzle performance.

After each cleaning operation the RMS average in memory 15*a-c* may be validated utilizing analyzer 17 against the reference values stored in memory, 16*a-c*. These values are established from RMS averages obtained from a known good cleaning operation.

The present invention may be embodied in other specific forms without departing from the spirit or essential attributes thereof and accordingly, reference should be made to the appended claims rather than to the foregoing specification as indicating the scope of the invention.

We claim:

1. A method for evaluating the operating status of an individual spray nozzle of a cleaning device from the exterior of a vessel wherein said cleaning device is a rotating spray head located within said vessel and includes a plurality of spray nozzles that rotate together about a common axis, said method comprising the steps of:

capturing sound signals from the exterior of said vessel when the cleaning device is in operation;

storing said sound signals as frequency patterns;

isolating sound peaks from said frequency patterns and separating said sound peaks into a number of different groups wherein the number of said groups is equal to the number of spray nozzles wherein each sound peak in a pattern is associated with a different one of said nozzles;

storing said sound peaks in a plurality of buffers, the number of said buffers being equal to the number of said spray nozzles;

comparing said plurality of sound peaks in each buffer with the plurality of sound peaks in each of the other buffers and identifying any of said plurality of sound peaks that substantially differs from the remaining plurality of sound peaks, and outputting indicia of the operating status of said cleaning device based upon said identification.

2. The method as claimed in claim 1 further including the step of averaging the sound peaks stored in each buffer.

3. The method as claimed in claim 2 wherein said comparing step compares the average of the sound peaks stored in each buffer.

* * * * *